US006468043B1

(12) United States Patent
Benvenuti

(10) Patent No.: US 6,468,043 B1
(45) Date of Patent: Oct. 22, 2002

(54) PUMPING DEVICE BY NON-VAPORISABLE GETTER AND METHOD FOR USING THIS GETTER

(75) Inventor: Cristoforo Benvenuti, Moens (FR)

(73) Assignee: European Organization For Nuclear Research, Geneva (CH)

( * ) Notice: Subject to any disclaimer, the term of this patent is extended or adjusted under 35 U.S.C. 154(b) by 0 days.

(21) Appl. No.: 09/202,668

(22) PCT Filed: Jun. 18, 1997

(86) PCT No.: PCT/EP97/03180

§ 371 (c)(1),
(2), (4) Date: Dec. 18, 1998

(87) PCT Pub. No.: WO97/49109

PCT Pub. Date: Dec. 24, 1997

(30) Foreign Application Priority Data

Jun. 19, 1996 (FR) ..... 96 07625

(51) Int. Cl.[7] ..... F04B 37/02; F04F 11/00
(52) U.S. Cl. ..... 417/48; 417/53
(58) Field of Search ..... 417/48, 49, 51; 252/181.1, 181.6; 204/192.38

(56) References Cited

U.S. PATENT DOCUMENTS

| | | | | | |
|---|---|---|---|---|---|
| 2,175,695 | A | * | 10/1939 | Kniepen | 252/181.1 |
| 3,544,829 | A | | 12/1970 | Someya et al. | |
| 4,038,738 | A | * | 8/1977 | Fischmeister et al. | 29/420.5 |
| 4,050,914 | A | * | 9/1977 | Murphy | 417/51 |
| 4,097,195 | A | * | 6/1978 | Hill | 417/49 |
| 4,157,779 | A | * | 6/1979 | Ishii et al. | 228/176 |
| 5,101,167 | A | * | 3/1992 | Ikegami | 328/233 |
| 5,626,682 | A | * | 5/1997 | Kobari et al. | 134/8 |
| 5,688,708 | A | * | 11/1997 | Kato et al. | 437/51 |

FOREIGN PATENT DOCUMENTS

| | | | | |
|---|---|---|---|---|
| CA | 622379 | * | 6/1961 | 417/48 |
| DE | 745134 | | 12/1943 | |
| DE | 3814389 A1 | | 11/1989 | |
| EP | 0 426 277 A2 | | 5/1991 | 323/233 |
| FR | 953730 | | 12/1949 | |
| GB | 828982 | | 2/1960 | |
| WO | WO 94/02957 | | 2/1994 | |

* cited by examiner

*Primary Examiner*—Cheryl J. Tyler
(74) *Attorney, Agent, or Firm*—Larson & Taylor PLC

(57) ABSTRACT

The invention discloses a pumping device by non-vaporizable getter to create a very high vacuum in a chamber defined by a metal wall capable of releasing gas at its surface, characterized in that it comprises a thin layer of non-vaporizable getter coated on at least almost the whole metal wall surface defining the chamber.

3 Claims, 1 Drawing Sheet

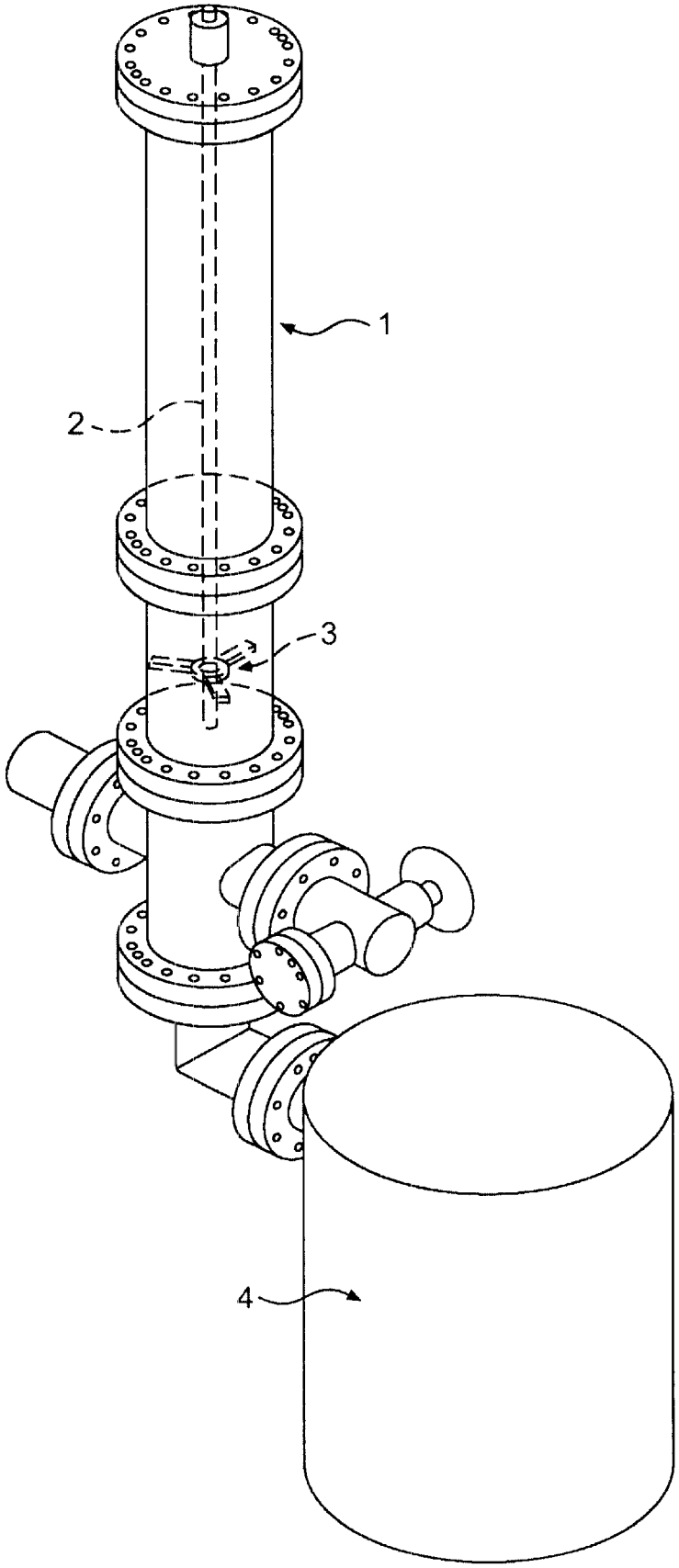
1
2
3
4

PUMPING DEVICE BY NON-VAPORISABLE GETTER AND METHOD FOR USING THIS GETTER

FIELD OF THE INVENTION

The present invention concerns improvements made to pumping by non-evaporable getter (NEG) to create a very high vacuum in a chamber defined by a metal wall capable of releasing gas at its surface.

BACKGROUND OF THE INVENTION

In a dehydrateable metal system in which a very high vacuum is to be made (i.e. a vacuum of at least $10^{-10}$ torr, or even of an order of magnitude of $10^{-13}$ to $10^{-14}$ torr), the metal walls of the vacuum chamber constitute an inexhaustible source of gas. The hydrogen contained in the construction metal (for example stainless steel, copper, aluminum alloy) diffuses freely in the thickness of the metal and is released at the surface defining the chamber. Likewise, when the vacuum chamber walls are bombarded with particles (synchroton radiation, electrons or ions)—as is the case in particle accelerators—, the result is the expulsion also of heavier molecular species, such as CO, $CO_2$, $CH_4$, produced at the surface after dissociation of hydrocarbons, carbides and oxides.

The level of vacuum obtained in the chamber is therefore defined by the dynamic equilibrium between the degassing at the surface defining the chamber and the pumping speed of the pumps used. Obtaining a high vacuum implies both a high order of chamber surface cleanliness reducing gas emission and a high pumping speed. For the vacuum systems of particle accelerators the chambers of which are generally of small section, pumps must be brought closer to each other or else continuous pumping has to be used, so as to overcome the limitation of conductance.

In these conditions, in order to obtain as high a vacuum as possible, it is known for the vacuum produced by mechanical pumps to be supplemented by carrying out additional pumping with the help of a getter placed in the chamber: this material is capable of producing chemically stable compounds by reaction with gases present in a vacuum chamber (particularly $H_2$, $O_2$, CO, $CO_2$, $N_2$) and this reaction causes the disappearance of the molecular species concerned, which equates to a pumping effect.

In order for the desired chemical reaction to occur effectively, it is necessary for the getter surface to be clean, i.e. free from any passivation coating formed during the exposure of the getter to the ambient air. This passivation coating may particularly be eliminated by diffusing the surface gases ($O_2$ mainly) within the getter by heating (a getter activation process which is then designated as a non-evaporable getter: NEG). Non-evaporable getters have it the advantage of being able to be made in the form of a strip which can then be placed all along the vacuum chamber so that the result is a distributed pumping effect.

However, whatever pumping process is used, and despite the effectiveness of the distributed pumping made possible by the use of a non-evaporable getter, the level of vacuum capable of being obtained in the chamber remains defined by the dynamic equilibrium between the pumping speed (whatever means are used) and the speed of degassing from the metal surface of the chamber (whatever its cause); in other words for a given pumping speed, the level of vacuum remains dependent on the degassing rate in the chamber.

Document EP-A-0 426 277 describes a vacuum chamber arrangement for a particle accelerator, in which the wall inner surface is covered with a coating of getter material.

However, when the chamber is constituted by a metal foil shaped by bending, rolling, folding etc., the coating of getter material is deposited on the plane metal foil, before its shaping: during this shaping operation of the metal foil, the getter coating runs a very high risk of being damaged, or even torn off in places.

Likewise, when the chamber is defined by several assembled (for example bolted) parts, the getter material is deposited on each part individually before they are assembled. In this case, only the largest parts are treated, whereas the smaller parts are not: in addition, in this case too the getter coating runs a very high risk of being damaged during the assembly process; in the final analysis, the getter coating does not uniformly cover the whole inner surface of the chamber.

Lastly, in view of the fact that only one face of the metal foil or of the individual parts is coated with getter material, it is not possible for the coating to be formed by using a vacuum deposition process (for example cathode sputtering), the only one able to lead to the formation of a thin coating. As a consequence, as it is deposited by using a different technique, the getter coating is a thick coating. As a result, the effectiveness of this getter coating is inferior.

Document DE-Al-28 14 389 describes a process for reducing the residual gas density in a high vacuum chamber. To this end a getter material is activated by a plasma discharge; the surface obtained is then freed of its oxygen and has low degassing under irradiation. However, carbon has no getter action on the H21 CO, CO2 substances which are the residual gases present in an ultra-vacuum system once the water has been eliminated.

In these conditions, the getter used in this known process cannot be reactivated by simple vacuum heating: it is not a non-evaporable getter. Moreover, although the substance mentioned may be called a getter, it is certainly not able to provide a getter action in an ultra-vacuum metal chamber such as the chamber of a particle accelerator.

SUMMARY OF THE INVENTION

The object of the invention is thus to propose an improved solution which allows this problem to be solved and which, because of the degassing rate occurring in the chamber, notably increases the effectiveness of the pumping means used and leads to an improvement of several orders of magnitude in the level of vacuum capable of being created in the chamber.

BRIEF DESCRIPTION OF THE DRAWING

The FIGURE shows a perspective view of the apparatus of the invention for providing a thin non-evaporable getter coating.

DETAILED DESCRIPTION OF THE PREFERRED EMBODIMENTS

To these ends, it is proposed according to the invention that at least almost the whole metal wall surface defining the chamber be covered with a thin non-evaporable getter coating which is vacuum deposited, particularly by cathode sputtering.

This getter coating constitutes a screen which inhibits the degassing of the metal from the chamber wall, without producing any in its turn. In addition, in the chambers of particle accelerators, it is this coating which is subjected to impacts from moving particles and which, forming a screen, prevents the release of molecular species capable of polluting the vacuum in the chamber. The result is that, by this means, degassing, whatever its cause, is prevented, at least to a great extent, in the chamber.

Moreover, a getter used in the form a such a coating retains the advantage of uniformly distributed pumping and is less likely than pressed powder deposition to release solid particles the effect of which can be harmful for some applications.

Lastly, a getter coating according to the invention takes up no perceptible space, and offers the advantage of providing a pumping effect of nil bulk, which allows its use even in cases where the geometric constraints would prohibit the use of a strip form getter. Likewise, in electron machines, the design of the vacuum chamber could be greatly simplified by the elimination of the now useless lateral pumping channel.

In order that the effectiveness of the thinly coated getter can lead to the desired optimum pumping effect, the material used has certain isolated or wholly or partly combined characteristics.

The material must clearly have great capacity for adsorption of the chemically reactive gases present in the chamber despite the barrier effect provided by the thin coating.

The material must also have great capacity for absorption of and great diffusivity for hydrogen, with capacity to form a hydride phase. It must, additionally, have a dissociation pressure of the hydride phase lower than $10^{-13}$ torr at about 20° C.

The material must also have the lowest possible activation temperature, compatible with the baking temperatures of vacuum systems (about 400° C. for stainless steel chambers, 200–250° C. for copper and aluminum alloy chambers) and compatible with the stability of the material in air, at about 20° C.; in these conditions, in a general way the activation temperature must be at the most equal to 400° C.

The material must lastly have great solubility, above 2%, for oxygen in order to allow the absorption of the quantity of oxygen pumped at the surface during a high number of cycles of activation and exposure to air. For example, with a 1 $\mu$m thick coating of non-evaporable getter and a 20 Å thickness of oxide formed on the surface at each exposure, a 2% oxygen concentration in the getter would be attained after about 10 cycles, not to mention the other gases pumped during the vacuum operation; thicker coatings could be envisaged, but they would be longer to apply and their adhesion could become less good.

In the final analysis, titanium and/or zirconium and/or hafnium and/or vanadium and/or scandium which have a solubility limit for oxygen, at room temperature, above 2% can constitute non-evaporable getters suitable to constitute a thin coating in the context of the invention. It will be noted that titanium, zirconium and hafnium have a solubility for oxygen close to 20%, whereas vanadium and scandium have great diffusivity for gases. Clearly it is also possible to accept, in isolation or in combination with at least one of the aforementioned substances, any alloy including at least one of the substances, so as to combine the effects obtained, and even to obtain new effects not directly resulting from the accumulation of individual effects.

By way of example, titanium is able to be activated at 400° C., zirconium at 300° C. and the 50% Ti-50% Zr alloy at 250° C. Activation at these temperatures for two hours reduces by four orders of magnitude the desorption rate induced by an electron bombardment of 500 eV of power and produces pumping speeds for CO and $CO_2$ of about 1 $ls^{-1}$ per $cm^2$ of surface.

It must be added as an additional advantage that the use of a getter in the form of a thin coating adhering to a metal substrate gives the latter the function of a thermal stabiliser capable of limiting the temperature in the thin coating. This layout is very advantageous since it allows materials to be used, as a getter, with high pyrophoricity without any safety problems arising on account of the stabilising effect conferred by the substrate the thermal capacity of which is high relative to the combustion heat of the thin getter coating.

Lastly it may be noted that the use of a non-evaporable getter in the form of a thin coating offers the possibility of creating thermodynamically unstable materials, which broadens the field of choice of the optimum getter material. This possibility can be simply exploited by using a technique of simultaneous cathode sputtering of several substances, with the help of a composite cathode which is discussed below.

According to a second of its aspects, the invention proposes a process for using a non-evaporable getter to create a high vacuum in a chamber 1 defined by a metal wall capable of releasing gas at its surface, which process includes the following stages:

- the chamber 1 is cleaned; the thin coating deposition device is inserted into the chamber 1; a relative vacuum is created in the chamber 1; the chamber 1 is dehydrated so as to remove the greatest possible part of the water vapour; then the getter is deposited in a thin coating over at least the greater part of the surface of the wall defining the chamber 1;
- atmospheric pressure is re-established in the chamber 1; and the deposition device is extracted from the chamber 1;
- the chamber 1 internally coated with the thin getter coating is assembled within the installation which it is to equip; a relative vacuum is created; the installation is dehydrated at the required temperature while maintaining the chamber at a temperature lower than the activation temperature of the getter;
- dehydration of the chamber is stopped and simultaneously the temperature of the chamber is raised to the getter activation temperature which is maintained for a predetermined period (for example 1 to 2 hours); and lastly the temperature of the chamber is brought back to room temperature.

At the end of this procedure, the surface of the thin getter coating is clean and its thermal degassing where induced by particle bombardment (ions, electrons, or synchroton light) is markedly reduced. At the same time a phenomenon of molecular pumping becomes apparent due to the chemical reaction, on the surface of the getter coating, of the gases present in the chamber pumped from a pumping station 4.

In order to carry out the deposition of the thin getter coating on the chamber wall surface, it is certainly possible to use a vacuum evaporation process; however, such a process seems difficult to control effectively in order to constitute a uniform and homogenous coating in particular during the simultaneous deposition of several substances, and it seems in practice more advantageous to use a cathode sputtering process which enables a much more effective control of formation conditions of the thin coating.

Moreover, a cathode sputtering process enables several materials to be deposited simultaneously so as to form an alloy type getter combining materials having different optimum characteristics the accumulation of which is sought, as shown above. In order to do this, a cathode 2 is constituted, intended to be placed centrally in the chamber 1 via a centering device 3, which is an electronic insulator. The cathode 2 may be constituted by a twist of several (for example two or three) metal wires of the respective materials of the alloy that it is desired to form. Use of a composite cathode thus constituted allows the simultaneous deposition of several metals and an alloy of thermodynamically unstable materials to be artificially created which it would not be possible to obtain by other traditional methods.

The means proposed by the invention offer the unrivalled possibility of producing high vacuums of $10^{-10}$ to $10^{-14}$ torr for laboratory applications, for thermal and/or sound insulation and for surface analysis systems, especially when they are used for reactive materials. However, it must be noted that the use of the invention in vacuum systems often exposed to the atmosphere or operating at low vacuums would lead very rapidly to saturation of the surface of the thin getter coating and that the advantages mentioned above could not be achieved.

More specifically, a particularly interesting field of application of the invention is constituted by the obtaining and maintenance over a long period of time of a high vacuum in particle accelerator/accumulators for which the conditioning period by particle beam circulation would then be removed and in which problems of vacuum instability would be eliminated.

What is claimed is:

1. A process for using a non-evaporable getter to create, due to a getter function, a very high vacuum in a chamber defined by a metal wall capable of releasing gas at a surface thereof, said non-evaporable getter being deposited on at least a majority of said chamber wall surface, the process comprising:

(a) cleaning the chamber;

(b) placing in the chamber a cathode sputtering device capable of coating the chamber;

(c) creating .a vacuum in the chamber and dehydrating the chamber;

(d) depositing a thin screen coating of a non-evaporable getter by cathode sputtering on said majority of said chamber wall surface;

(e) reestablishing atmospheric pressure in the chamber and removing the deposition device from the chamber;

(f) assembling said chamber with a vacuum system;

(g) making a vacuum with said vacuum system;, (h) dehydrating said vacuum system at a given temperature while maintaining said chamber at a temperature lower than a temperature of activation of said non-evaporable getter;

(i) stopping said dehydrating of said vacuum system, and simultaneously raising the temperature in said chamber up to said activation temperature;

(j) maintaining said activation temperature for a predetermined period suitable for cleansing said non-evaporable getter coating; and (k) lowering the temperature in said chamber to room temperature.

2. The process according to claim 1, wherein said non-evaporable getter is selected from the group consisting of titanium, zirconium, hafnium, vanadium, scandium, and alloys thereof.

3. The process according to claim 1 for depositing a non-evaporable getter coating comprising an alloy of several metals, wherein a cathode comprising several wires of said respective alloy metals twisted around each other is placed centrally in said chamber.

* * * * *